United States Patent [19]

Imperiale

[11] Patent Number: 4,516,384

[45] Date of Patent: May 14, 1985

[54] METHOD AND APPARATUS FOR OPENING AND LOADING FLEXIBLE CONTAINERS

[75] Inventor: Nino Imperiale, Milan, Italy

[73] Assignee: W. R. Grace & Co., Cryovac Div., Duncan, S.C.

[21] Appl. No.: 336,231

[22] Filed: Dec. 31, 1981

[30] Foreign Application Priority Data

Mar. 16, 1981 [GB] United Kingdom ..... 8108129

[51] Int. Cl.[3] ..... B65B 43/30; B65B 43/28; B65B 43/34

[52] U.S. Cl. ..... 53/459; 53/570; 53/571

[58] Field of Search ..... 53/570, 571, 573, 384, 53/459, 468, 512, 381 R, 492; 271/33

[56] References Cited

U.S. PATENT DOCUMENTS

| | | | |
|---|---|---|---|
| 2,702,150 | 2/1955 | Vogt | 53/570 |
| 3,083,961 | 4/1963 | Arbter | 271/33 |
| 3,448,557 | 6/1969 | Swaithes | 53/573 X |
| 3,509,689 | 5/1970 | Perrin | 53/571 |
| 4,078,358 | 3/1978 | Henderson | 53/468 X |
| 4,137,958 | 2/1979 | Golby et al. | 53/572 X |
| 4,182,094 | 1/1980 | Lieder et al. | 53/571 X |
| 4,271,656 | 6/1981 | Russell | 53/381 R |

*Primary Examiner*—Horace M. Culver

*Attorney, Agent, or Firm*—John J. Toney; William D. Lee, Jr.

[57] ABSTRACT

A plastic bag is opened by positive contact with a run of adhesive tape over two guide rolls which are then lifted to raise the upper panel of the bag at locations above spreader bars which can enter the bag in a relatively closed configuration and then spread apart to hold the bag thereon. The spreader bars are then caused to lift the bag from the bag-opening location and to transport it to a bag-loading location leaving the next successive bag at the opening station for contacting with the adhesive tape which has by now been indexed.

20 Claims, 10 Drawing Figures

METHOD AND APPARATUS FOR OPENING AND LOADING FLEXIBLE CONTAINERS

The present invention relates to a method of and apparatus for opening flexible containers, and in particular to the opening of flexible envelopes and plastics bags for packaging purposes.

It has for many years now been known to employ automatic or semi-automatic processes and apparatus for opening a succession of bags into which products are to be loaded. The most widely used methods employ the use of air either as a suction medium to separate the two panels bordering the mouth of a flat bag, (for example in U.S. Pat. No. 3,945,173), or as an inflation jet which either blasts apart the mouth panels or initially passes over one of the panels to attract that panel transversely towards the core of the air jet by virtue of the reduced static pressure exerted by the air jet on the surrounding bag material (as in U.S. Pat. No. 3,774,367). It has also been proposed to use apparatuses which employ a combination of both the suction opening and air inflation mechanisms. There have also been proposals to use grippers for transporting bags by mechanical contact, to use adhesives to hold a bag neck during the loading operation (see U.S. Pat. No. 3,509,689), and to use bag spreader means for holding a bag mouth open during bag loading (see U.S. Pat. No. 3,945,173, for example).

Apart from giving rise to obvious advantages, which have been exploited in practice in the past, the use of air for suction and/or blowing to open bags also entails disadvantages. For example, where suction is used to open the bags, there is the danger that any debris which is often inevitable in a bag loading environment can be sucked into the suction passages and can block them, rendering the bag opening means ineffective. Also, the air jets which achieve opening and/or inflation generate considerable air currents around the apparatus which again tend to displace debris and cause operator discomfort. Furthermore, such apparatuses using air as the means for separating the superposed panels of a flat folded bag in a succession of such bags automatically presented at an opening station require considerable time lag as the bag mouth is first opened and then fully erected, and an article is then loaded into the bag.

It is an object of the present invention to provide a more rapid method of and apparatus for more rapidly and efficiently opening flexible containers, preferably without the use of air suction and/or inflation jets.

Accordingly, one aspect of the present invention provides a process for opening and loading flexible containers each having first and second superposed flexible panels defining a mouth of the flexible container, comprising: separating said superposed panels of a first said flexible container at a container-opening station by non-pneumatic separating means; inserting spreading means between said superposed panels; spreading said first flexible container over the spreading means to hold the container in secure contact thereon; and moving said spreading means to transport the spread first flexible container from said container-opening station to a container-loading station; loading said spread first flexible container at said container-loading station; and beginning the separation of said first and second superposed panels of a second said flexible container at said container-opening station during the loading of the first flexible container at said container-loading station.

Another aspect of the invention provides a process for opening and loading flexible containers each having a mouth defined between first and second superposed flexible panels, comprising: establishing non-slip contact of a movable member with a portion of said first panel of a said flexible container at a container-opening station; mechanically displacing the contacted portion of the first panel to separate the said first and second panels at least at said contacted portion of the first panel; inserting container-spreading means into the thus opened gap between said first and second panels; spreading said flexible container to grasp it on said spreading means; and displacing the spreading means from said opening station to a loading station to transport the thus grasped flexible container thereon.

The invention also provides apparatus for opening and loading flexible containers each of which comprise two superposed flat panels, such apparatus including: a container-opening station having non-pneumatic means for separating said superposed flat panels; spreader means driven for entry into a said flexible container between said separated panels; means for transporting said spreader means from said container-opening station to a container-loading station where a product article can be inserted into said flexible container; and programming means for effecting separating of the first and second panels of a second said flexible container at said container-opening station during loading of the first-mentioned flexible container at said container-loading station.

A fourth aspect of the invention provides apparatus for opening and loading flexible containers each of which has superposed first and second panels defining a flat said flexible container having an open mouth, comprising a container-opening station; non-slip contact means at said container-opening station to contact a said first panel of a said flexible container at said container-opening station; means for mechanically displacing said non-slip contact means for displacing the contacted portions of said first panel to effect separation of said first and second panels at the container mouth; spreading means adapted to enter the opened container mouth and to spread said mouth to hold the container mouth thereon; a transfer device for transporting said spreading means between said opening station and a container-loading station; and means at said container-loading station for loading a product into said opened flexible container.

By using means for positively contacting and mechanically displacing one of the container mouth panels with respect to the other to an extent to allow mechanical spreader means to enter the flexible container, it is possible to ensure that the preliminary phase of the opening operation proceeds reliably and rapidly. Furthermore, the rapidity of the repetitive container-opening operations on a succession of flexible containers is enhanced by the fact that the spreader means enters the opened flexible container then transports that flexible container away from the opening location towards a loading location, thereby freeing the next delivered flexible container (either the next uppermost bag on a wicketed bag stack, or the next top bag on a boxed stack, or the next bag on a chain of imbricated bags, or the next bag of a chain of perforated bags such as side-sealed bags) to be opened ready for receiving the spreading means when the next preceding flexible container has been loaded.

In order that the present invention may more readily be understood the following description is given, merely by way of example, with reference to the accompanying drawings in which.

Figure 1:
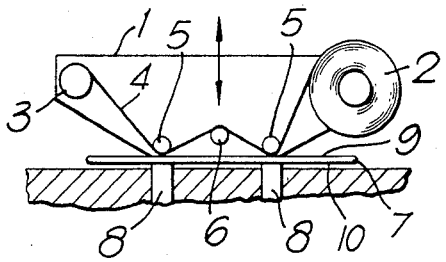
FIG. 1 is a front view of a first form of mechanism for mechanically displacing a mouth panel of a flexible container, in this case a plastics bag, using contact between an adhesive tape and the panel.

Referring now to FIG. 1, there will be seen a frame 1 carrying a pay-out roller 2 and a wind-up roller 3 between which extends a band 4 of adhesive tape. The tape supply on the pay-out roll 2 will be several tens of meters in length and is coiled in the same way as domestic adhesive tape, namely with the adhesive coating on the radially inwardly facing side of the tape as it lies on the roll.

The run of the tape 4 from the pay-out roll 2 to the wind-up roll 3 is by way of a pair of spread guide means 5, which may be rotatable rolls or stationary spindles over which the tape is allowed to slide, and a central support roll 6 which will be rotatable and will have its surface adapted to avoid picking up the adhesive from the coated surface of the tape 4 with which it comes into rolling contact.

As can clearly be appreciated from FIG. 1, the tape run 4 presents two downwardly directed apices where the tape passes over the guide means 5, and between these two apices the tape is arranged in an upwardly directed apex the main function of which is to ensure that there is no continuous contact of the tape with a plastics bag 7 under the two spaced guide means 5 between the two above-mentioned apices defined thereby.

Bags 7 are supplied to the opening location depicted in FIG. 1 by way of being adhesively secured to support tapes 8 in the manner of a conventional taped imbricated bag chain. After opening of each bag 7, in a manner to be described below, the tapes 8 are indexed to pull another bag to the location previously occupied by the just-opened bag 7 ready for it too to be opened.

The opening action is achieved by adhesion of the upper face of the bag to the apices in the run 4 of the adhesive tape as the tape is guided by the rollers 5 or analogous means. Consequently, at two spaced locations having a spacing equivalent to the horizontal separation between the axes of the guide means 5 the upper face 9 of the bag 7 will be positively contacted by the tape and will be mechanically lifted as the guide means 5 lift. In the FIG. 1 embodiment the guide means 5 are lifted by raising of the frame 1 as a whole, but it is envisaged that other alternative possibilities exist where the guide means 5 rise without movement of the pay-out roll 2 and wind-up roll 3 (and possibly even without raising of the central roller 6) also carried by the same frame 1.

In the embodiment illustrated in FIG. 1 the pay-out roll 2, the wind-up roll 3, the spaced guide means 5 and the central roll 6 are all carried by the frame 1 and are fixed thereto. Consequently, lifting of the guide means 5 will cause vertical movement of the contacted zones of the upper panel 9 of the bag 7. However, other possibilities exist, for example lifting of the central roll 6 and simultaneous lateral approaching movement of the two guide means 5 so as to ensure not only that the upper panel 9 is lifted at two locations, but also that these locations are drawn towards one another in order more positively to induce opening of the bag in a way analogous to the bag-opening action to be described with reference to FIG. 3 below.

After the opening of one bag 7, or of a limited number of bags 7, the tape 4 will be advanced by indexing rotation of the wind-up roll 3 (by suitable drive means such as the mechanism to be described below with reference to FIGS. 9 and 10) to present a fresh portion of the tape 4 at the righthand guide means 5 and to present at the lefthand guide means 5 preferably an unused portion of the tape 4 or possibly a portion which has been used only once or a few times on the righthand guide means 5.

By suitable arrangement of the indexing movement of the tape 4 it is possible to ensure that a portion of the tape which is freshly presented at the lefthand guide means 5 has not already been used to contact one or more earlier bags.

The bag-opening device of FIG. 1 will be described in more detail below with reference to FIGS. 9 and 10, but for the present it is convenient to describe first of all the alternative bag-opening mechanisms of FIGS. 2 and 3 and then the bag spreading mechanism of FIGS. 4 to 8 before embarking on a detailed description of the drive means for the mechanism of FIG. 1.

The bags 7 presented to the opening station depicted in FIG. 1 may be in the form of a taped imbricated bag chain as described above, or alternatively in the form of a stack of bags, for example a "wicketed" stack (in which the bag stack is held firm by an inverted U-shaped stable or "wicket" which is so-named because of its similarity to a cricket wicket) or a chain of perforated bags so that the chain is formed with perforations between each bag and the next successive bag along the chain (the bags being either side-sealed with the mouth facing sideways of the chain, or in any other convenient configuration, as desired).

Figure 2:
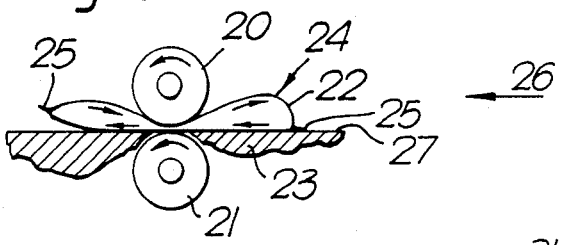
FIG. 2 is a front elevational view of an alternative embodiment of device for mechanically displacing a mouth-defining panel of a flexible container using co-rotating friction wheels.

The alternative bag-opening device shown in FIG. 2 comprises an upper rotating friction roller 20 and a lower rotating friction roller 21, both driven for indexing rotation in the same direction (in this case in the anti-clockwise sense) forming therebetween a nip between which the upper panel 22 and the lower panel 23 of a plastics bag 24 are arranged.

The particular form of bag illustrated in FIG. 2 has side seams 25 formed by sealing together the overlapping panels 22 and 23 giving a degree of rigidity to the lateral margins of the bag.

In this particular case the bag 24 fed to the nip 23 is advanced laterally (along the direction of the horizontal arrow 26) so that the lefthand side seam 25 passes through the nip between the upper and lower rollers 20 and 21 to allow the bag to be advanced towards the position shown in FIG. 2. Thus during bag feeding movement the two rollers 20 and 21 rotate in opposite directions, the lower roller 21 rotating in the anticlockwise direction and the upper roller 20 rotating in the clockwise direction, and then when bag opening is required the upper roller 20 rotates in the anticlockwise direction as before while the lower roller 21 reverses its direction of rotation to the anticlockwise direction so that opposing peripheral movements occur at the nip and the material of the bag panels is caused to slide with the upper panel 22 moving rightwardly and the lower panel 25 moving leftwardly in the nip. This movement tends to roll the righthand side of the bag so as to press the righthand side seam 25 downwardly onto a support table 27, and to lift the lefthand side seal 25 of the bag from the support table; thus to each side of the nip the bag material opens out at the mouth. This opening action is facilitated by virtue of the stiffness of the side seams 25 and the plastics material of the upper and lower panels 22 and 23 near the side seams, and for that reason the bag-opening device of FIG. 2 is particularly convenient for use with side-sealed bags as opposed to bags formed from a tubular starting stock where each bag is basically a flat-folded tube having its lateral margins formed by the folds joining the superposed bag panels and the closed bottom end of the bag defined by a seal. (It is envisaged that the mouth end of such a bag will roll in the flat configuration rather than curl upwardly as illustrated in FIG. 2). Such side-sealed bags may, for example, be delivered to the bag opening station of FIG. 2 in the form of a side-sealed perforated bag chain.

An alternative possibility for feeding the bags to the bag-opening station of FIG. 2 is that the upper friction roller 20 may be vertically liftable in order to allow a bag 24 to be advanced into the space between the upper and lower rollers 20 and 21 and then the upper roller 20 descends to close the nip onto the upper and lower bag panels 22 and 23. The direction of feed may then be either rightwardly or leftwardly (for example leftwardly along the arrow 26 of FIG. 2) or into or out of the plane of the paper, as desired.

As a variation of this particular bag-opening device it is possible for the lower roller 21 to be replaced by a stationary counter surface of a material likely to exert frictional grip on the bag lower panel 23 so that the bag separating slip occurs by virtue solely of the rotation of roller 20.

Figure 3:
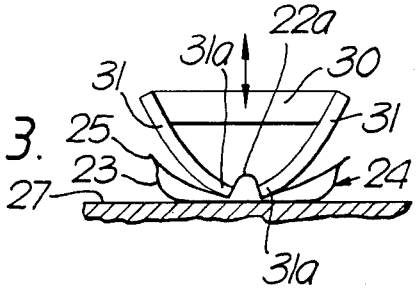
FIG. 3 is a front elevational view of a further embodiment of device for mechanically displacing a mouth-defining panel of a flexible container, using friction fingers operating on one panel.

The bag-opening station shown in FIG. 3 includes a support frame 30 carrying two resilient rubber fingers 31 which, in the relaxed state, extend downwardly convergently towards a bag support plate 27, to define between their free ends a space which is analogous to the spacing between the two guide means 5 of FIG. 1 and which is therefore the spacing between the points of direct contact of the fingers 31 with a bag 24 on the support plate 27.

The frame 30 is lifted while the bag 24 is placed on the support table 27 therebelow. In this case the support plate is formed of a high friction material, such as rubber, in order to prevent slipping of the underneath panel 23 of the bag thereover. Once the bag 24 is in place, the frame 30 descends and the two finger tips 31*a* contact the bag with a non-slip positive frictional contact at locations which are spaced apart by a distance equivalent to the abovementioned spacing between the two tips in the relaxed configuration of the fingers 31. Further depression of the frame 30 towards the support table 27 causes the finger tips 31*a* to approach one another and, as a result, the region 22*a* of the upper panel of the bag buckles upwardly as shown in FIG. 3. More importantly, the marginal regions of the bag near the side seals 25 curl upwards in a manner analogous to the curling of the lefthand part of the bag 24 shown in FIG. 2. Thus mechanical movement of the upper panel of the bag invariably curls the side-sealed bag 24 to achieve opening near the lateral margins.

The opening device of FIG. 3 may be used with either a taped chain of side-sealed bags, or a stack (for example a wicketed stack in which case the wicket serves to hold the lower panel 23 of the uppermost bag of the stack since the conventional wicketed stack has the top panels free to lift but the lower panel stapled by the wicket until the bag is torn from the wicket).

The opening devices of FIGS. 1, 2 and 3 have in common the separation of the upper panel of the bag from the lower panel of the bag at two spaced regions symmetrical to either side of the centre line of the bag. This then presents the bag mouth in the optimum configuration for entry of spreader means, as will be described with reference to FIGS. 4, 5 and 6, and to FIGS. 7 and 8. Although FIGS. 4 and 7 show the bag-opening device of FIG. 1 and not those of FIGS. 2 and 3, the same spreader means 43 or 70, respectively, can be used with each of the three bag-opening devices of FIGS. 1, 2 and 3.

Figure 4:
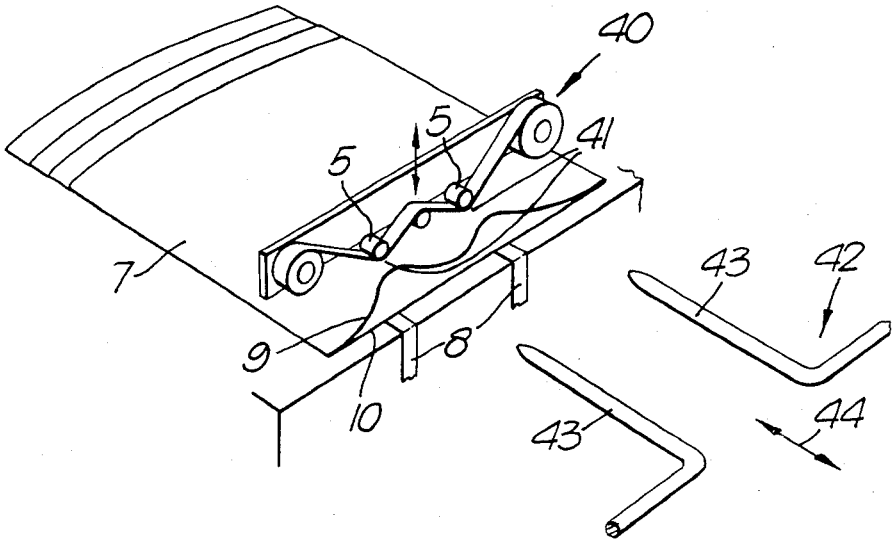
FIG. 4 is a perspective view of the panel-displacing device of FIG. 1 working in combination with spreading means about to enter the flexible container.

Referring now to FIG. 4, there can be seen the vertically reciprocating bag-opening assembly 40 (comprising all the elements described in FIG. 1) having just lifted regions 41 of the upper panel of a bag 7 such that the regions 41 coincide with the vertical projections onto the bag of the spaced guide means 5 of the device 40. The arrangement is preferably such that these two locations 41 are directly above the points of adhesive attachment of the tapes 8 to the lower panel of the bag 7.

In thise case, the spreader means generally designated 42 comprise a pair of spreader bars 43 which enter the bag mouth immediately between the raised locations 41 and the held-down corresponding zones of the bottom bag panel at tapes 8. This entering movement is depicted by the arrow 44 of FIG. 4.

Once the two spreader bars 43 have sufficiently penetrated the open mouth of the bag 7, the bars 43 are moved laterally apart until they each abut the lateral margin of the bag 7 (in this case a fold between the upper and lower panels of the bag 7) and then hold the bag 7 thereover by a tensioning action.

By this time the upper panel of the bag 7 will be under tension and will tend to pull downwardly away from the adhesive tape 4 at the apices defined by the guide means 5, although this will probably not be a sufficiently strong downward pull to achieve separation of the tape 4 from the upper panel 9 of the bag. Consequently, the guide means 5, with or without the rest of the opening means 40, will need to rise higher to achieve separation of the upper panel 9 from the tape 4.

The spreader bars 43 then move to displace the bag to achieve separation of the tapes 7 from the underneath panel (for example by lifting the bag clear of the tapes, or by any other suitable movement of the bag 7 to achieve peeling of the lower panel of the bag from the tapes 8) and then transport the separated bag 7 to a further location ready for loading of the bag. This immediately frees the bag opening means 40 to descend onto the next bag which will be drawn into position therebelow by indexing of the carrier tapes 8 and consequently opening of the next successive bag can be carried out while the previous bag 7 is now being loaded at the separate loading station.

Figure 5:
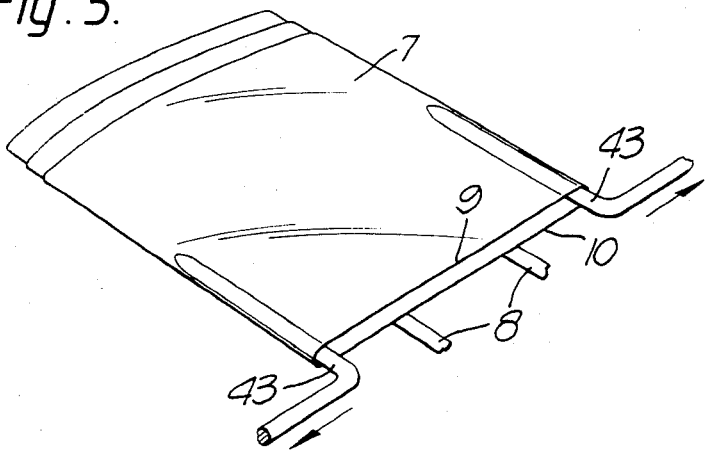
FIG. 5 is a perspective view showing the flexible container after entry and spreading of the spreading means.
Figure 6:
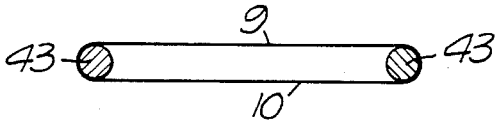
FIG. 6 is a front elevational view of the container and the spreading means in the FIG. 5 configuration.
Figure 7:
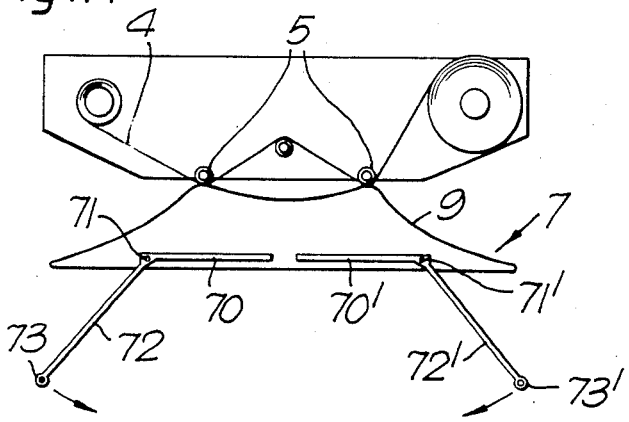
FIG. 7 is an end elevational, partly schematic, view of an alternative form of spreading means which also erect the container mouth.

FIG. 5 shows the configuration of the bag 7 as the spreader bars 43 reach the margins of the bag, and this same configuration is shown in end elevational view in FIG. 6.

The spreader means 43 illustrated in FIGS. 4 to 6 comprise circular cross-section bars which may, for example, include orifices to allow the same spreader bars to be used either to evacuate the interior of the bag after an article has been placed in the bag or to inject an inert gas into the bag before sealing. However, there are various other possibilities for the spreader means whose important function is to carry the bag from the area where the positive contact and mechanical displacement of the bag panel has opened the mouth to an extent sufficient for the spreader means 43 to enter, and then to transport that bag to a remote location to free the opening means to carry out the next bag opening operation which will occur simultaneously with the closing stages of the bag loading operation on the preceding bag.

Figure 8:
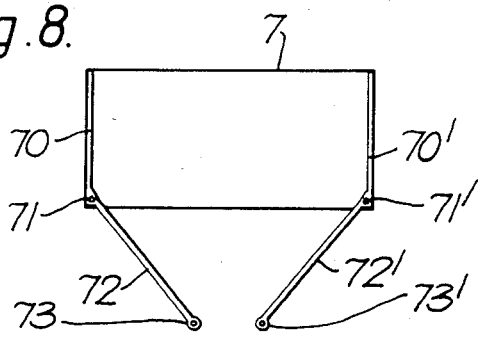
FIG. 8 is a view similar to FIG. 7, but after erection of the container mouth.

For example, one alternative form of bag spreader means (shown in FIGS. 7 and 8) may comprise a pair of spreader plates 70,70' which are in horizontal configuration before entering the bag mouth and which, after entry, rotate so that they now define side walls of a bag loading passage and they hold the bag mouth under tension in a configuration which is (as shown in FIG. 8) adapted to accommodate the product article in question.

For example, for an article of square or rectangular cross-section the plates may be planar as shown and may finish up in a vertical configuration defining a square or rectangular opening (depending on the dimensions of the plates and of the bag mouth perimeter) for the product article.

Alternatively, where the cross-section of the article to enter the bag is other than square or rectangular, the plates may either be pivoted to a position which is not vertical or may themselves be non-planar in order to define a convex opening.

FIG. 7 shows such opening plates entering a bag in the folded flat configuration, and FIG. 8 shows them in the erected configuration in which the bag mouth is held with a cross-section matched to that of a rectangular article to go therein.

As shown in FIG. 7, the lefthand spreader plate 70 is articulated at 71 to a mounting pivot and is integral with one end of a drive lever 72 whose other end 73 is adapted to be connected to a drive linkage which rotates the drive arm 72 and the spreader plate 70 in the anti-clockwise direction to arrive at the FIG. 8 configuration of these components. The righthand spreader plate 70' is pivoted at 71' and integral with a drive lever 72' having its end 73' adapted to be driven for rotation of the spreader plate 70' and the drive arm 72' in the clockwise direction to arrive at the FIG. 8 configuration. The linkage 72, 72' will of course be capable of accommodating movement of the spreader plates 70, 70' into the bag 7. In the flat-folded configuration shown in FIG. 7, the spreader plates 70, 70' are directly beneath the highest points of the bag, i.e. the points where the upper panel 9 of the bag 7 is attracted adhesively to the apices of the tape run 4 at the guide means 5, thereby ensuring the maximum space for entry of the spreader plates 70 and 70' which move into the bag in a direction away from the viewer of FIG. 7.

Once the spreader plates 70 have penetrated the bag 7 to a sufficient extent, further movement into the plane of the paper stops and then the plates 70 and 70' are rotated about their pivots 71, 71' to bring them vertical and to erect the mouth of the bag 7 (in this case to form a rectangular cross-section opening) ready to receive a product article. There may simultaneously be some separating movement of the pivots 71, 71' of the spreader plates 70, 70' in order to tension the bag.

The transportation of the bag from the opening station to the loading station may take place before, after or during pivotal movement of the plates 70, 70' between their FIG. 7 and FIG. 8 configurations.

As mentioned above, other forms of bag-spreading means may be provided, operating in an appropriate way to enter the partially opened bag after positive contacting and mechanical displacement of a bag panel and then moving the bag to a loading location.

Figure 9:
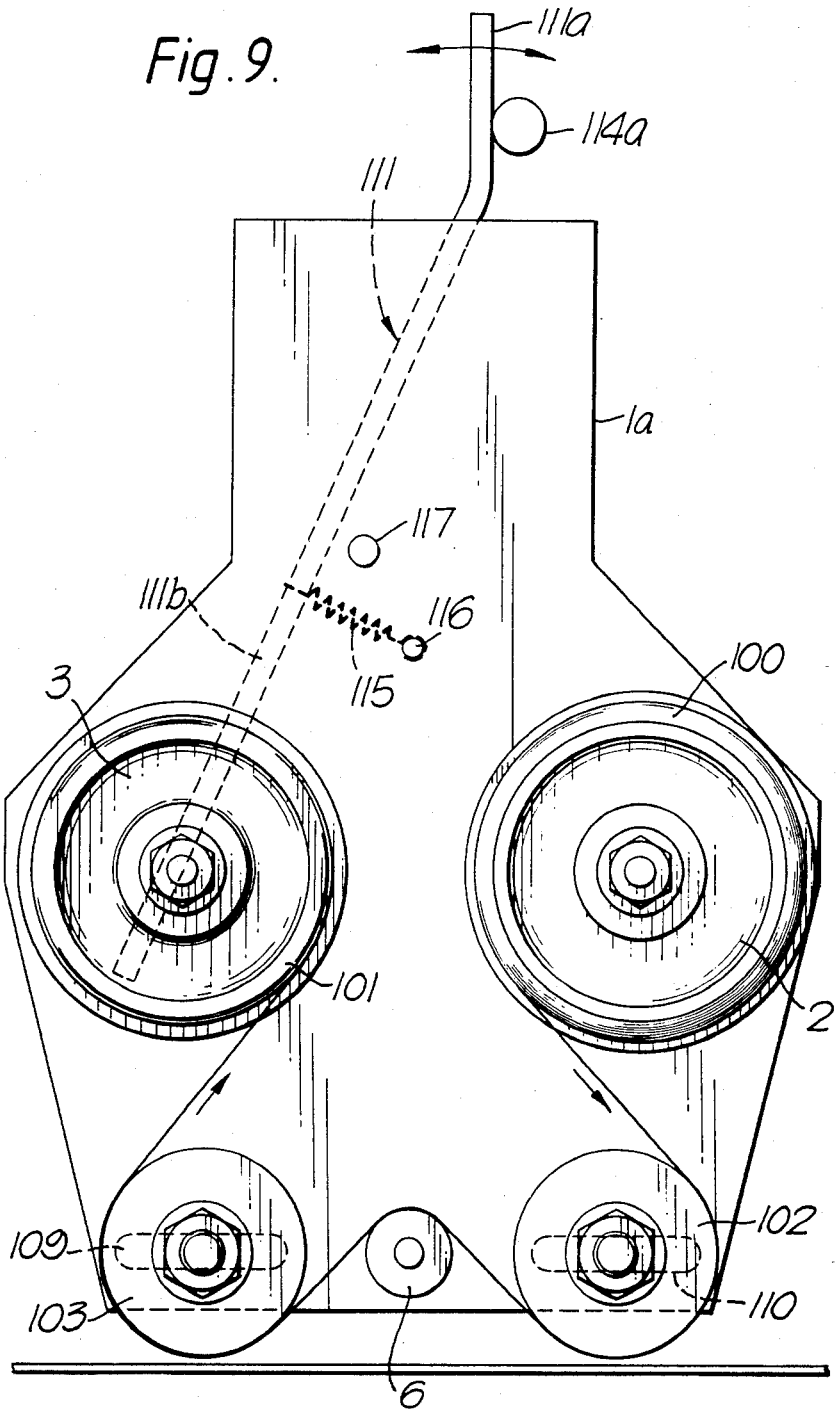
FIG. 9 is a detail view of a modified form of the device of FIG. 1, showing the drive mechanism for the tape transport.
Figure 10:
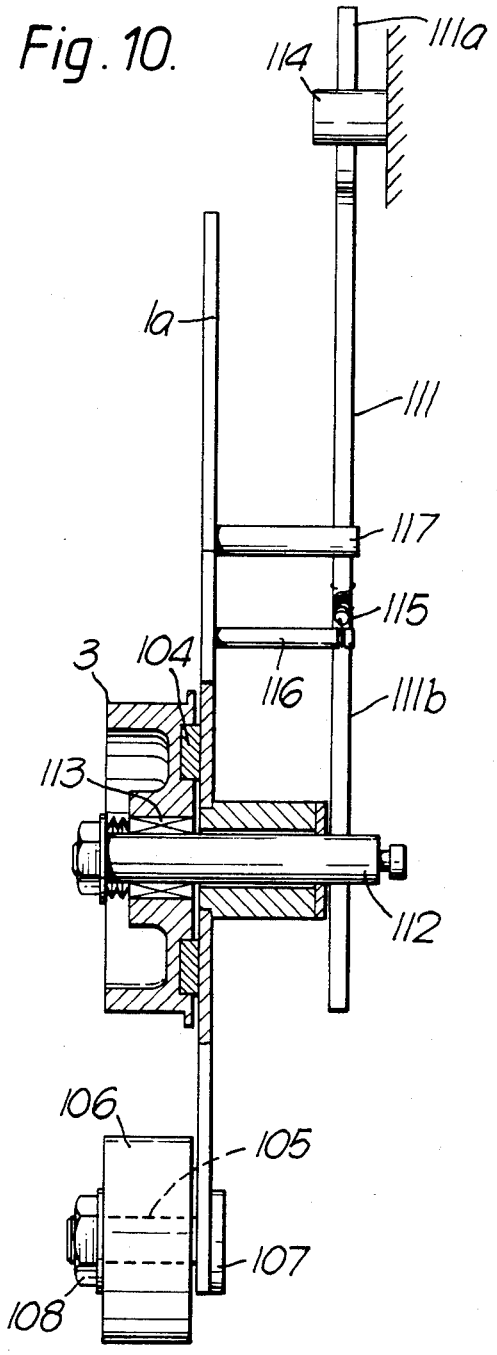
FIG. 10 is a side elevational, partly sectional, view of the device of FIG. 7 looking from the lefthand side of FIG. 7.

The particular form of bag-opening device shown schematically in FIGS. 1 and 4 is illustrated in more detail in FIGS. 9 and 10.

FIG. 9 shows a different shape for the carrier plate here referenced 1*a*, and supporting (a) the tape pay-out roll 2 with a build-up 100 of adhesive plastic tape thereon, (b) the wind-up roll 3 with a build-up 101 of used adhesively coated tape thereon, as well as (c) the guide means in this case comprising rollers 102 and 103 (analogous to the guide means 5 of FIGS. 1 and 4) and the central roller 6 which together define a run for the adhesive tape 4 which presents the two desired laterally spaced downwardly facing apices and the single central upwardly facing apex on the central roller 6.

The central roller 6 has its surface coated with polytetrafluoroethylene to act as a release agent to prevent the adhesive from the surface of the tape from sticking to the roller 6. Alternatively, the periphery of the roller 6 could be knurled or otherwise profiled in order to reduce the contact area and thereby to reduce the chance of the tape sticking on the roller 6.

Although not shown in FIGS. 9 and 10, the tape pay-out roll 2 has a friction brake to prevent it rotating freely and paying out too much tape during the incremental rotation steps of the tape wind-up roller 3. The wind-up roller 3 itself has a similar friction brake which is shown in FIG. 10 as comprising a friction lining 104 at the back of the roller 3 and rubbing on the carrier plate 1*a* to resist free rotation of the roller 3.

Given that the pay-out roller 2 and the wind-up roller 3 is resisted by suitable friction damping means such as the friction brake, no similar rotation resistance is needed for the rollers 102, 103 and 6.

As shown in FIG. 9, the positions of the two apex-defining guide rollers 103 are adjustable towards and away from one another by virtue of the fact that each roller comprises an inner stator portion 105 co-axially supporting an outer rotor portion 106, the stator portion being clamped to the carrier plate 1*a* by means of a threaded stud having a large head 107 positioned behind the carrier plate 1*a* and a nut 108 on the front of the carrier plate to clamp the stator 105 in position. The threaded shank of the stud projects through the carrier plate at a horizontally extending slot 109 which thereby allows lateral movement of the stud towards and away from the central roller 6 of the carrier plate to vary the positioning of the guide roller 103. A similar arrangement exists for the guide roller 102 whose slot 110 can clearly be seen in FIG. 9.

Behind the plane of the carrier plate 1*a* (i.e. to the righthand side as viewed in the side elevational view of FIG. 10) is a cam follower arm 111 which has a straight portion 111*b* connected to the drive shaft 112 of a freewheel device 113 of the tape wind-up roller 3 and a cranked end portion 111*a* extending parallel to the direction of movement of the carrier plate 1*a* and in sliding contact with a stationary pin 114 which is positioned totally behind the plane of the vertically reciprocating carrier plate 1*a*.

A tension spring 115 is connected between the first-mentioned portion 111*b* of the lever 111 and a stud 116 fixed on the carrier plate so as always to bias the portion 111*a* of the arm 111 in the clockwise direction as viewed in FIG. 9.

As the carrier plate 1*a* rises from the FIG. 9 configuration, the pin 114 will slide relative to the arm 111 initially in a direction parallel to the end portion 111*a* thereof (which being parallel to the direction of movement of the carrier plate does not result in any rotation of the arm 111) until the pin 114 rounds the corner and embarks upon sliding movement along the portion 111*b* and from then on the spring 115 is able to bias the arm 111 for rotation in the clockwise direction through an angle whose displacement from the FIG. 9 position is directly responsive to the lifting movement of the carrier plate 1*a* beyond the position at which the pin 114 rounds the corner onto the portion 111*b*.

Eventually the portion 111*b* of the arm 111 will have been pulled by the spring 115 onto a stop in 117 and further carrier plate lifting beyond that state will be unable to result in further pivoting movement of the arm 111.

During this lifting movement, the freewheel 113 allows the arm 111 to pivot in the clockwise direction as viewed in FIG. 9, and the friction lining 104 prevents the wind-up roller 3 from following the arm 111.

However, once the carrier plate 1*a* begins to descend again, the pin 114 will recontact the portion 111*b* of the arm 111 and then begin to drive the arm 111 for rotation in the anti-clockwise direction which causes the freewheel 113 to engage and to drive the wind-up roller 3 for rotation in the anti-clockwise direction with a torque which exceeds the braking torque of the friction lining 104 against the carrier plate 1*a*. This anti-clockwise rotation of the wind-up roller 3 causes indexing of the tape run 4 to an extent sufficient to present fresh tape on the righthand guide roller 102 and either fresh or once-used tape on the lefthand guide roller 103 (as suggested above).

The device shown in FIG. 9 thus provides a self-acting indexing movement which replenishes the exposed tape portion each time the carrier plate 1*a* descends into contact with the next bag at the opening station.

As indicated above, the two apex-defining guide rollers 102, 103 may be mounted on completely separate carriers which each have a tape pay-out roller and a tape wind-up roller with a drive means analogous to that shown in FIG. 9, for example where a much wider spacing is required for the apex-defining guide means and also where a much wider range of adjustment for the guide means is needed.

I claim:

1. A process for opening and loading flexible containers each having a mouth defined between first and second superposed flexible panels, such process comprising the steps of:

(a) establishing non-slip contact of first and second movable members with respective portions of said first and second panels of a said flexible container at a container-opening station;

(b) mechanically displacing the contacted portions of the first and second panels in opposite directions by sliding the first panel over the second, said sliding displacement causing the edges of said flexible container to roll and separate the panels near said edges;

(c) inserting container-spreading means into the thus opened gap between said first and second panels;

(d) spreading said flexible container to grasp it on said spreading means; and (e) displacing the spreading means from said opening station to a loading station to transport the thus grasped flexible container thereon.

2. A process according to claim 1, wherein said first and second movable members are rollers rotating in the same direction and having peripheries which thereby move in opposite directions to slide said panels with respect to one another.

3. A process according to claim 1, wherein there are two said movable members each engageable with said first panel at spaced locations to draw the said spaced locations of said first panel towards one another for rolling the flexible container to effect separation of the two superposed panels near the lateral edges thereof.

4. A process according to claim 3, wherein said members are resilient fingers which have a relaxed configuration in which they are divergent in a direction towards the flexible container such that, when they are moved towards the container, the tips of said fingers will initially contact said first panel and then upon further movement towards the container pinch said contacted portions of the first panel towards one another.

5. A process according to claim 1, wherein said flexible container is a sidesealed plastics bag having said first and second panels separated at one end to define an open mouth and joined down lateral portions of the bag and along the closed bottom of the bag by respective seal lines.

6. A process according to claim 1, wherein said spreader means comprise a pair of parallel bars which enter said flexible container by axial movement and then separate laterally to spread said flexible container under tension thereon.

7. A process according to claim 1, wherein said spreader means comprise spreader plates which initially enter said mouth between the separated portions of said first and second panels in a configuration generally parallel to the configuration of said panel portions before separation, and then rotate to form a container loading passage holding the flexible container in a fully opened configuration and guiding a second product into said container.

8. A process according to claim 7, wherein said spreader plates are planar.

9. A process according to claim 1, wherein the form of said flexible containers which are presented at said container-opening station is selected from the group consisting of: (a) continuous supply of taped imbricated bags, (b) a stack of superposed bags, and (c) a chain of perforated bags.

10. Apparatus for opening and loading flexible containers each of which has superposed first and second panels defining a flat said flexible container having an open mouth, such apparatus comprising:

(a) a container-opening station;

(b) non-slip contact means at said container-opening station to contact a said first panel of a said flexible container at said container-opening station;

(c) means for mechanically displacing said first panel comprising a rotatable roller, a countersurface, means mounting said rotatable roller in a closely spaced position relative to said counter surface, whereby said rotatable roller exerts mechanical displacement on a said first panel by rotation of said roller, so as to slide the first panel with respect to the second panel to effect separation of said first and second panels at the container mouth;

(d) spreading means adapted to enter the opened container mouth and to spread said mouth to hold the container mouth thereon;

(e) a container-loading station where a product is loaded into a said opened container;

(f) a transfer device for transporting said spreading means between said container-opening station and said container-loading station; and (g) means at said container-loading station for loading a product into said opened flexible container.

11. Apparatus according to claim 10, wherein said countersurface comprises a second said roller, and including means driving said second roller for rotation in the same direction as said first roller so that the nip between the first and second rollers is defined by the roller peripheral surfaces which have mutually opposed directions of movement.

12. Apparatus according to claim 11, and including means for introducing a said flexible container into the space between the first-mentioned roller and said countersurface.

13. Apparatus according to claim 12, wherein said means for introducing a said flexible container between said first-mentioned roller and said countersurface includes means for moving said first-mentioned roller and said countersurface towards and away from one another for separating said roller and said countersurface to allow introduction of a said flexible container therebetween.

14. Apparatus according to claim 12, wherein said means for introducing a said flexible container between said first and second rollers comprise means for driving said first and second rollers synchronously in opposed directions of rotation in a container in-feed operation for introducing a said flexible container into the nip between said first and second rollers.

15. Apparatus according to claim 13, including a support surface for a said flexible container, and wherein said means for positively contacting and mechanically displacing said first panel comprises a carrier, a pair of resilient fingers extending convergently from said carrier towards said support surface, said support surface being adapted to exert a frictional hold on said second panel of a said flexible container, and said fingers having tips which exert a frictional hold on said first panel of the same flexible container as said carrier moves towards and away from said support surface.

16. Apparatus according to claim 10, wherein said spreader means comprise parallel spreader bars, means mounting said spreader bars for movement towards and away from one another to spread a said flexible container in tension therearound, and means moving said spreader bars from said container-opening station to said container-loading station.

17. Apparatus according to claim 16, wherein said spreader bars include suction nozzles for evacuating a said flexible container thereon after loading.

18. Apparatus according to claim 10, wherein said spreading means comprise spreader plates and means mounting said spreader plates for pivotal movement between (a) a first configuration in which they extend in a generally parallel direction towards and away from one another and are readily able to enter a space between the separated first and second panels of a said flexible container, and (b) a second configuration in which they have pivoted away from the position of general parallelism and spread said container mouth into a position suitable for receiving a product between the plates.

19. Apparatus according to claim 18, wherein said spreader plates are generally planar.

20. Apparatus according to claim 18, wherein said means mounting said spreader plates for pivotal movement comprise spaced pivot means having parallel pivot axes, and means moving said pivot means of said spreader plates towards and away from one another for spreading a said flexible container over the erected spreader plates and moving them both in a direction parallel to said pivot axes for driving the spreader plates into the gap between the separated first and second panels of a said flexible container at said container-opening station.

* * * * *

UNITED STATES PATENT AND TRADEMARK OFFICE

CERTIFICATE OF CORRECTION

PATENT NO. : 4,516,384

DATED : May 14, 1985

INVENTOR(S) : Nino Imperiale

It is certified that error appears in the above-identified patent and that said Letters Patent is hereby corrected as shown below:

In column 10, Line 65, delete the word "second", substituting therefor --said--.

Signed and Sealed this

*Nineteenth* Day of *November 1985*

[SEAL]

*Attest:*

DONALD J. QUIGG

*Attesting Officer*

*Commissioner of Patents and Trademarks*